US005992295A

United States Patent [19]

Noda et al.

[11] Patent Number: 5,992,295

[45] Date of Patent: Nov. 30, 1999

[54] SLIDE UNIT

[75] Inventors: Mitsuo Noda, Ichinomiya; Tsuyoshi Yonezawa, Nakashima-gun, both of Japan

[73] Assignee: Howa Machinery, Ltd., Nagoya, Japan

[21] Appl. No.: 09/048,314

[22] Filed: Mar. 26, 1998

[30] Foreign Application Priority Data

Apr. 29, 1997 [JP] Japan ..... 9-126360

[51] Int. Cl.[6] ..... F01B 29/00

[52] U.S. Cl. ..... 92/88; 92/137; 277/DIG. 7

[58] Field of Search ..... 92/88, 137; 277/DIG. 7

[56] References Cited

U.S. PATENT DOCUMENTS

| | | | |
|---|---|---|---|
| Re. 34,049 | 9/1992 | Taki et al. | 92/88 |
| 4,373,427 | 2/1983 | Garlapaty et al. | 92/88 |
| 4,813,341 | 3/1989 | Vaughn | 92/88 |
| 5,473,971 | 12/1995 | Takeuchi et al. | 92/88 |
| 5,701,798 | 12/1997 | Noda | 92/88 |
| 5,724,880 | 3/1998 | Noda | 92/88 |

FOREIGN PATENT DOCUMENTS

| | | |
|---|---|---|
| 0 280 309 | 8/1988 | European Pat. Off. . |
| 295 07 142 | 7/1985 | Germany . |
| 43 34 424 | 4/1994 | Germany . |
| 49-77388 | 7/1974 | Japan . |
| 50-89775 | 7/1975 | Japan . |
| 60-237208 | 11/1985 | Japan . |
| 62-177304 | 8/1987 | Japan . |
| 62-266206 | 11/1987 | Japan . |
| 63-190906 | 8/1988 | Japan . |
| 62-225708 | 9/1988 | Japan . |
| 1-132804 | 9/1989 | Japan . |
| 2-21305 | 2/1990 | Japan . |
| 3-4005 | 1/1991 | Japan . |
| 3-7506 | 1/1991 | Japan . |
| 3-12006 | 2/1991 | Japan . |
| 7-158612 | 6/1995 | Japan . |
| 7-44795 | 11/1995 | Japan . |

*Primary Examiner*—Hoang Nguyen
*Attorney, Agent, or Firm*—Finnegan, Henderson, Farabow, Garrett & Dunner, L.L.P.

[57] ABSTRACT

The slide unit includes a rodless power cylinder having a cylinder tube. End caps are attached to both ends of the cylinder tube. A slit extending in parallel with the axis of the cylinder tube is formed on the wall of the cylinder tube. A piston is disposed in the bore of the cylinder tube and is movable along the slit. An external carriage is connected with the piston by a yoke extending through the slit. An inner seal band and an outer seal band extending along the slit for closing the opening of the slit from the inside and outside, respectively, are provided. The ends of the inner seal band and the outer seal band are inserted into corresponding recesses formed on each of the inner end faces of the end caps. A pin hole crossing the recesses and extending to the upper face of each end cap is provided. A fitting hole is disposed on each end of the inner seal band and the outer seal band at the position corresponding to the pin hole. The inner seal band and the outer seal band are secured to each end cap by inserting a fitting pin into the fitting holes at the ends of the seal bands through the pin hole. Since the seal bands are secured to each end cap only by a fitting pin, the assembly of the seal bands is largely simplified.

14 Claims, 10 Drawing Sheets

SLIDE UNIT

BACKGROUND OF THE INVENTION

1. Field of the Invention

The present invention relates to a slide unit which uses a rodless power cylinder having an external carriage driven by a piston in a cylinder barrel. The external carriage is connected to the piston by a coupling member protruding from the cylinder barrel through a slit formed in the wall of the cylinder barrel. The slit in the cylinder barrel is sealed by an inner seal band and an outer seal band.

2. Description of the Related Art

A slide unit utilizing a rodless power cylinder is known in the art. A rodless power cylinder includes a cylinder barrel having an axial slit in the wall and a piston disposed in the bore of the cylinder barrel. The bore of the cylinder barrel is divided by the piston and forms two pressure chambers, one on each side of the piston. The piston is moved within the bore by introducing pressurized fluid into the pressure chambers. The movement of the piston is transferred to an external carriage by a coupling member which connects the external carriage to the piston through the slit in the cylinder barrel. Usually, an inner seal band is disposed on the inner wall surface of the bore along the slit in order to prevent leakage of the pressurized fluid. Further, an outer seal band is disposed outer wall surface of the cylinder barrel along the slit in order to prevent an incursion of dust into the cylinder barrel.

Slide units of this type are disclosed in various publications.

For example;

(A) Japanese Unexamined Patent Publications (Kokai) No. 63-190906, No. 60-237208, No. 62-177304 and No. 3-4005 disclose rodless power cylinders in which the ends of the seal bands are secured to end members (end caps) disposed on the both ends of the cylinder barrel by clamping the seal bands between fitting screws screwed into threaded holes formed on the wall of the cylinder barrel and the side surface of the end members.

(B) Japanese Unexamined Patent Publications (Kokai) No. 62-266206 and No. 63-225708 disclose rodless power cylinders in which the ends of the seal bands are secured to the end members by clamping the seal bands between fitting plate and the end members. Further, a fitting pin which penetrates the seal band through a fitting hole disposed on each end of the seal bands is used for securing the seal band to each end member.

(C) Japanese Unexamined Patent Publication (Kokai) No. 50-89775 discloses a rodless power cylinder in which the seal bands are secured to the end members by inserting the bottom portion of a T-shaped fitting piece into a fitting hole disposed on each end of the seal bands and by securing the fitting pieces to the end members by securing screws.

(D) Japanese Unexamined Utility Model Publications (Kokai) No. 3-12006, No. 7-44795 and No. 2-21305 disclose slide units having end members at the both ends of the cylinder barrel. The end members of the slide units in these publications are provided with mounting bolt holes through which mounting bolts are passed and tightened to external structures in order to mount the slide units to the structures. The end members in these publications are made of aluminum alloy so that the end members withstand the tightening load of the mounting bolts.

(E) Further, Japanese Unexamined Utility Model Publication (Kokai) No. 1-132804 discloses a slide unit having end members made of synthetic resin such as polyacetal. However in this case, since the strength of polyacetal is not sufficient for withstanding the tightening loads of the mounting bolts, separate L-shaped metal brackets are used for mounting the slide unit to the external structure. These brackets are attached to the end members by screwing fitting bolts into threaded bolt holes formed on the heads of fitting bolts used for fitting the end members to the cylinder barrel. The slide unit is mounted to an external structure via the L-shaped metal bracket.

(F) Japanese Unexamined Utility Model Publication (Kokai) No. 49-77388 discloses a rodless power cylinder having end members. In this publication, the end members are attached to the ends of the cylinder barrel using fitting bolts screwed into threaded bolt holes on the end faces of the cylinder barrel.

(G) Japanese Unexamined Utility Model Publication (Kokai) No. 3-7506 and Japanese Unexamined Patent Publication (Kokai) No. 7-158612 disclose slide units having stoppers for the external carriages. The stoppers in these publications are attached to the cylinder barrels using clamp members fitted to guide grooves or recesses formed on the outer surfaces of the cylinder barrels.

In the rodless power cylinders of the publications (A), since the seal bands are clamped between the fitting screws and the circumferences of the end members, it is necessary to screw the fitting bolts into the threaded holes of the cylinder barrels. This increases the number of steps required for assembling the rodeless power cylinders. Further, if the fitting screws become loose, the sealing abilities of the seal bands may be lowered due to a decrease in the tension of the seal bands. In addition to that, since the heads of the fitting screws are visible from the outside of the cylinder barrel, the exterior views of the rodless power cylinders are deteriorated by the heads of the fitting screws.

Further, when the end members are made of soft materials, for example, a synthetic resin such as polyacetal, the clamping force may become insufficient due to softness of the material and a creep inherent to synthetic resin. This also causes an insufficient sealing performance of the seal bands.

In the rodless power cylinders of the publications (B) and (C), since fitting pins or fitting pieces are used for securing the seal bands, the problem caused by the loosening of the fitting screws does not occur. However, additional fitting plates or T-shaped fitting pieces are required for securing the seal band. Further, since these fitting plates and fitting pieces must be secured to the cylinder barrel, problems of the increase in the number of steps for assembling the rodless power cylinder and the deterioration of the exterior view also occur in the rodless power cylinder of the publications (A).

In the slide units of the publications (D), since the end members are made of aluminum alloy, the manufacturing process of the end members is complicated and the cost incurred increases. Further, the weight of a whole slide unit increases due to the heavy aluminum end members.

Further, in the slide units of the publications (E) and (F), the configurations for fitting the end members to the cylinder barrels are complicated. This causes increase in the manufacturing cost of the slide unit.

In the slide unit of the publications (G), since the stoppers are attached to the cylinder barrel using clamping members engaging the guide grooves or recesses formed on the surfaces of the cylinder barrels, the guide grooves and the recesses are easily damaged when excessive forces are exerted thereon from the clamping members. Also a complicated process is required for attaching the end members to the cylinder barrels.

SUMMARY OF THE INVENTION

In view of the problems in the related art as set forth above, one of the objects of the present invention is to provide a slide unit in which the seal bands are easily secured to the end members without requiring any tightening work of screws or bolts.

Another object of the present invention is to provide a slide unit in which removable end covers, which cover the heads of the fitting pins of the seal bands and act as the means for preventing the pins from falling out, can be attached to the end members without increasing the number of steps for assembling the slide unit.

Further another object of the present invention is to provide a slide unit in which the end members and cylinder barrels can be manufactured at low cost.

Another object of the present invention is to provide a slide unit in which the stopper member for the external carriage can be easily secured to the slide unit without damaging the surface of the guide grooves or the recesses of the cylinder barrel.

One or more of the objects as set forth above are achieved by a slide unit, according to the present invention, comprising a cylinder barrel provided with a slit which penetrates the wall of the cylinder barrel and extends parallel to the axis of the cylinder barrel, end members fitted to both ends of the cylinder barrel and close both ends of a bore of the cylinder barrel, an internal moving body, having two ends, disposed in the bore of the cylinder barrel and movable therein in the direction parallel to the axis of the cylinder barrel, an external carriage disposed outside of the cylinder barrel and coupled to the internal moving body by a coupling member through the slit in the cylinder barrel so that said carriage moves with the internal moving body along said slit, and a seal band provided with a fitting hole at each end portion thereof, said seal band disposed along the slit in the cylinder barrel so that the seal band covers the slit in the cylinder barrel, wherein each of the end members is provided with a recess formed on an end face opposing the cylinder barrel for receiving the end portion of the seal band and a pin hole extending from the surface of the end member and traversing said recess, and wherein the seal band is attached firmly to the end members by inserting a fitting pin into the pin hole of each end member in such a manner that the fitting pin passes through the fitting hole at the end portion of the seal band. According to the slide unit of the present invention, the seal bands can be secured to the end members by simply inserting the fitting pins into the pin holes of the end members. By doing so, the fitting pin passes through the fitting holes disposed at the ends of the seal bands and secures the seal bands firmly. Since only the fitting pins are used for securing the seal bands, the assembly work of the slide unit is largely simplified.

BRIEF DESCRIPTION OF THE DRAWINGS

The present invention will be better understood from the description as set forth hereinafter, with reference to the accompanying drawings in which.

DESCRIPTION OF THE PREFERRED EMBODIMENT

Figure 1:
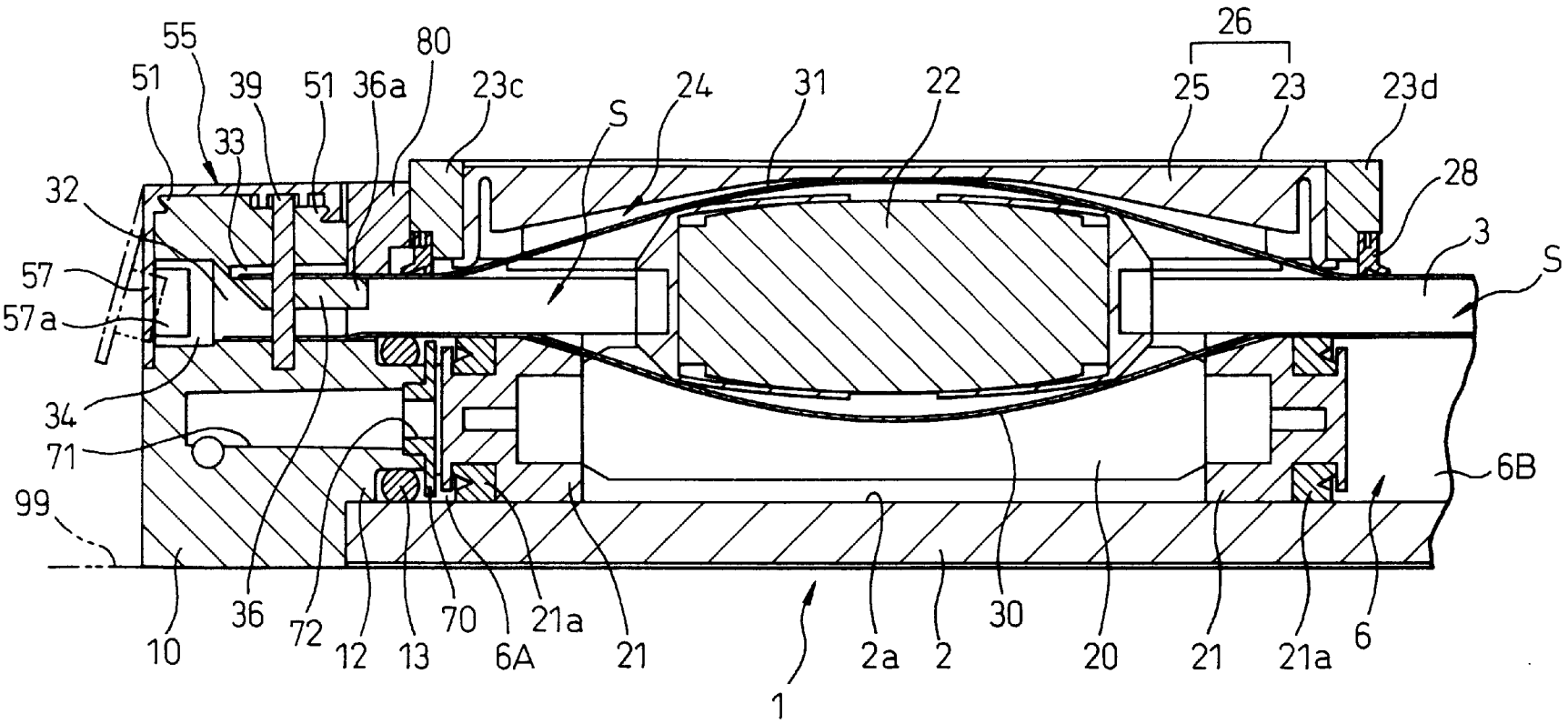
FIG. 1 is a longitudinal section view of a slide unit according to an embodiment of the present invention.
Figure 2:
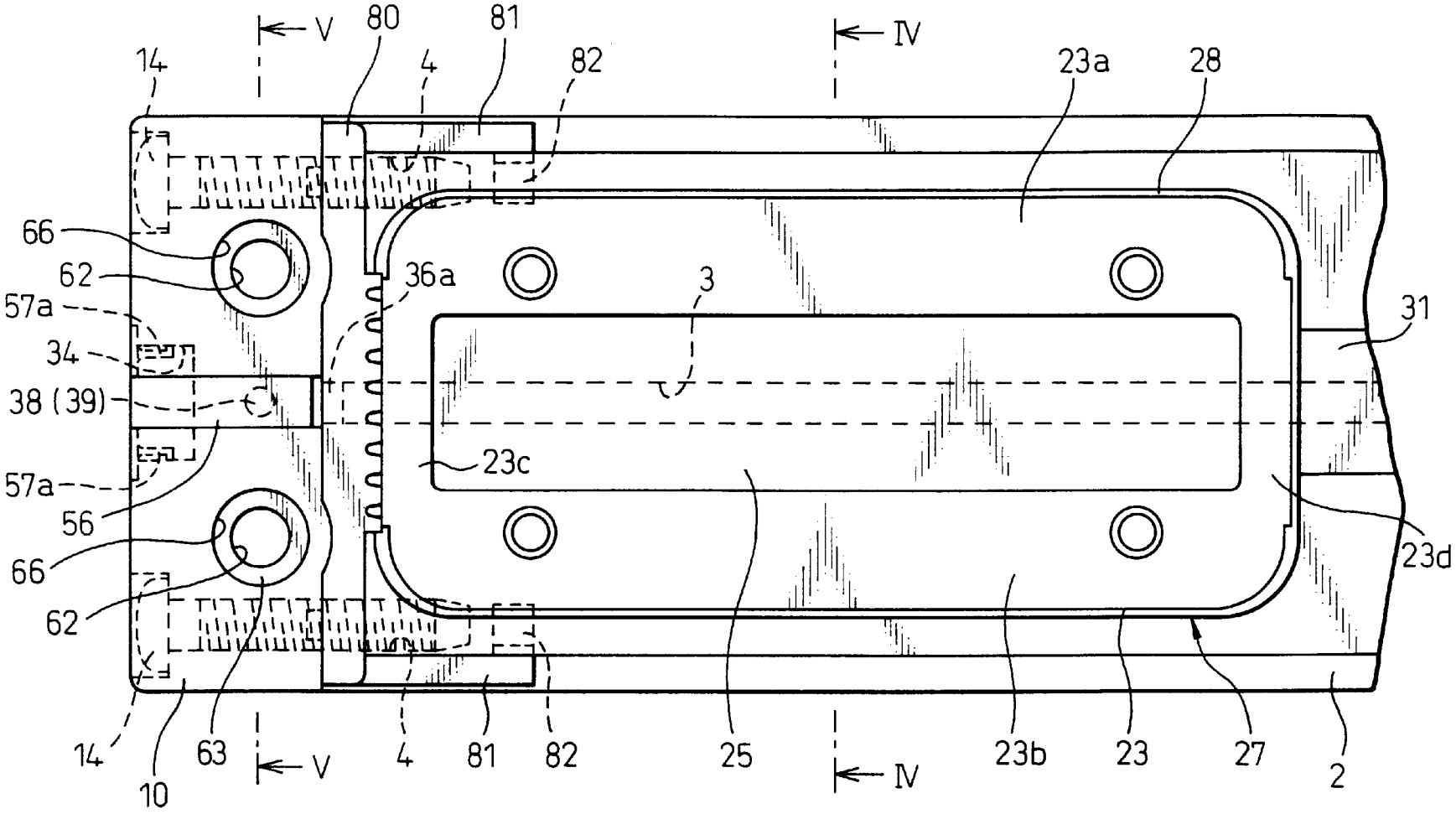
FIG. 2 is a plan view of the slide unit in FIG. 1.
Figure 3:
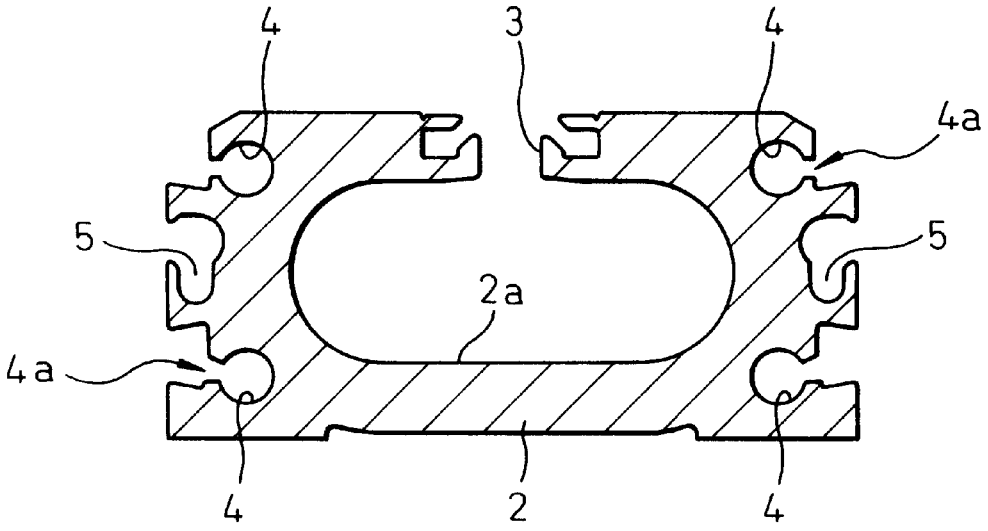
FIG. 3 is a cross section view of the cylinder tube of the slide unit in FIG. 1.
Figure 4:
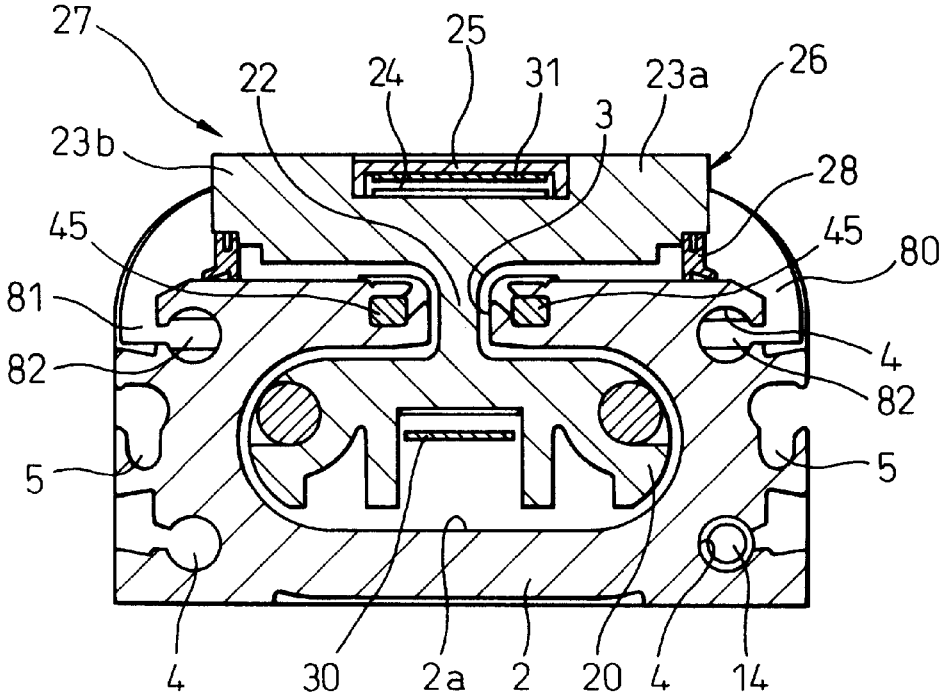
FIG. 4 is a sectional view taken along the line IV—IV in FIG. 2.

Hereinafter, an embodiment of the present invention applied to a slide unit utilizing a fluid driven (pneumatic) rodless power cylinder, will be explained with reference to FIGS. 1 through 9. In FIGS. 1, 3 and 4, reference numeral 1 designates a slide unit. Numeral 2 is a cylinder barrel (cylinder tube) of the slide unit 1 which is made of non-magnetic metal and formed by an extrusion or a drawing process. As shown in FIG. 3, the cylinder tube 2 has a non-circular (in this embodiment, an oblong circular) bore 2*a*. A slit opening 3 is formed on the side wall of the cylinder tube along the entire length thereof. On the outer wall of the cylinder tube 2, grooves 4 for attaching end members and grooves 5 for mounting attachments, such as sensors, are formed along the entire length of the cylinder tube 2.

Figure 8:
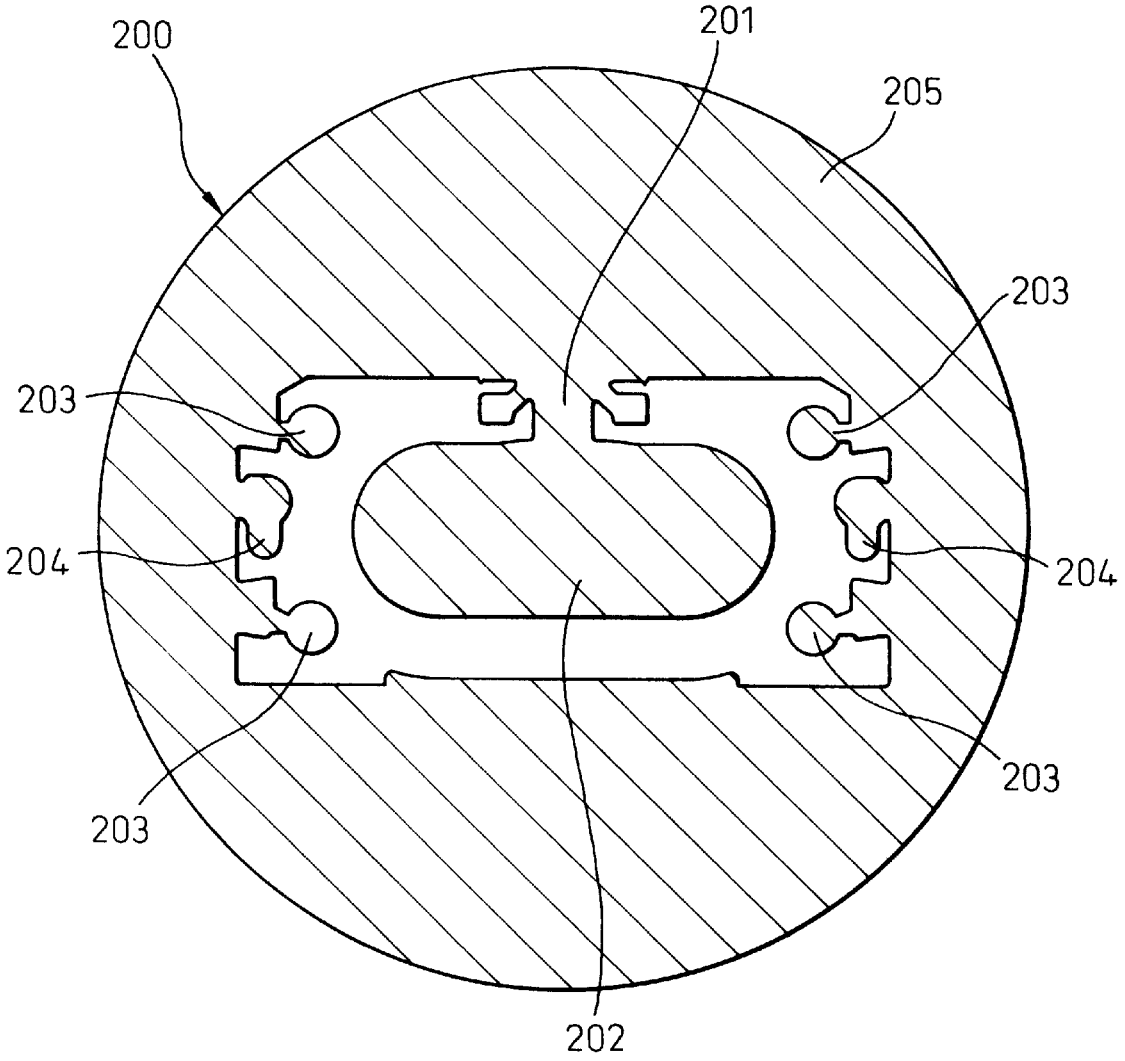
FIG. 8 shows the configuration of the die used for the extrusion or drawing process for producing the cylinder tube.

The groove 4 consists of an aperture 4*a* and the portion thereof inside the aperture 4*a* is circular shape having a diameter larger than the width of the aperture. Namely, the groove 4 is formed as a circular hole having a slit (the aperture) opening to the outer wall of the cylinder tube 2. As seen from FIG. 3, no closed space is formed in the cylinder tube 2, i.e., all the space within the cylinder tube 2 is open to the outside of the tube 2 via apertures extending in parallel with an axis of the cylinder tube 2. By this configuration, the construction of the die used for the extrusion forming or the drawing forming of the cylinder tube 2 can be simplified. FIG. 8 shows an example of a die 200 used for the extrusion or the drawing of the cylinder tube 2. As seen from FIG. 8, the portions 201, 202, 203 and 204 of the die 200 for forming the slit 3, bore 2*a*, grooves 4 and 5, respectively, are all cantilevered from the base portion 205 of the die.

Figure 7:
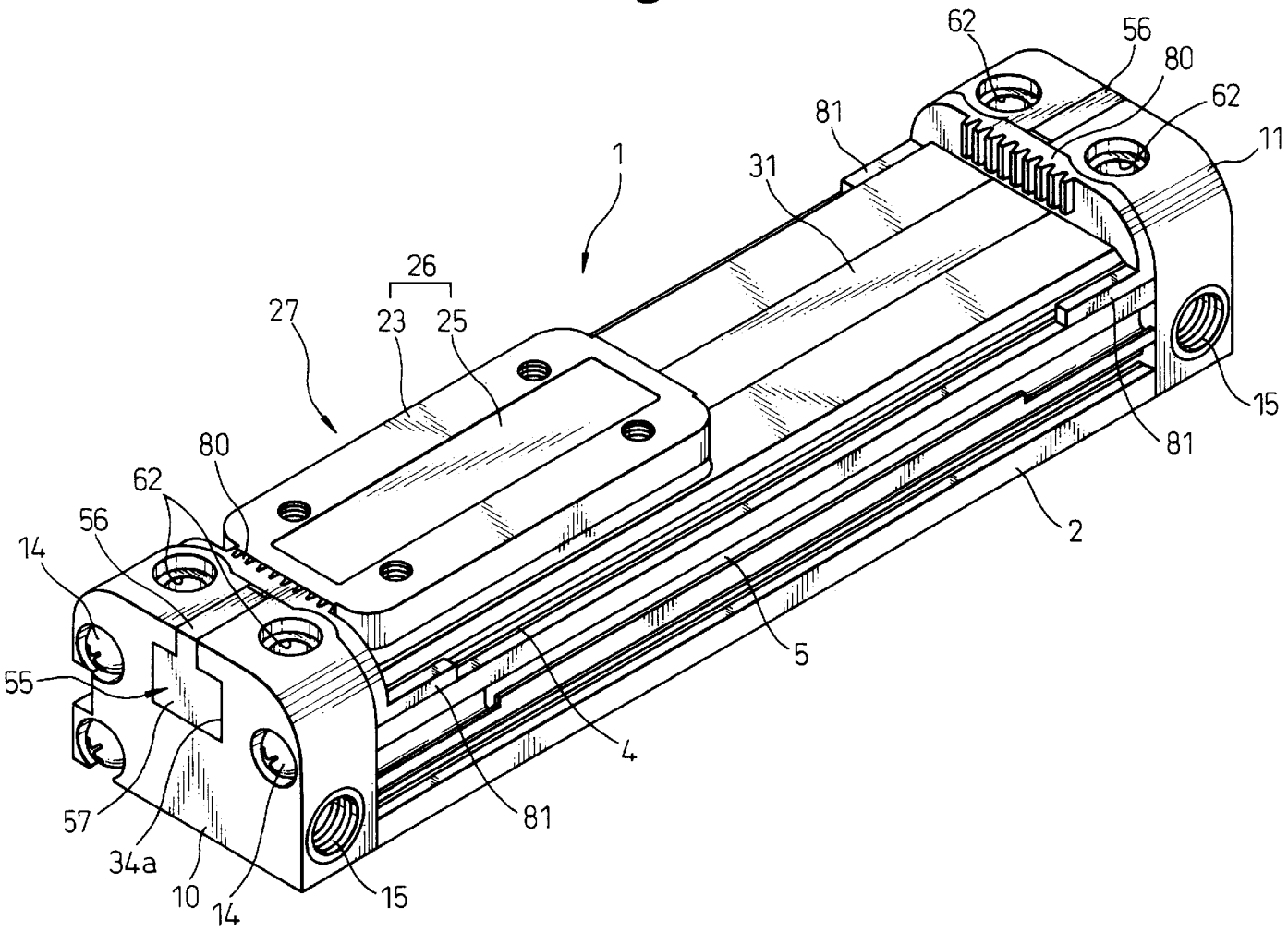
FIG. 7 is a perspective view of the slide unit in FIG. 1.

Both ends of the cylinder tube 2 are closed by end members (end caps) 10 and 11 and a cylinder chamber 6 is defined by the wall of the cylinder bore 2*a* and end caps 10, 11 as shown in FIG. 1. The end caps 10 and 11 have the configurations exactly mirror symmetrical to each other. Therefore, hereinafter only the end cap 10 will be explained. As seen from FIG. 1, the end cap 10 has a portion protruding above the cylinder tube 2 and a portion 12 inserted into the cylinder tube 2 with a cylinder gasket 13 intervening therebetween. When attaching the end cap 10 to the cylinder tube 2, the end cap 10 is aligned to the cylinder tube 2 by inserting the portion 12 into the bore 2*a* and a protruding portion 36*a* of an intermediate wall portion 36 into the end of the slit 3. The intermediate wall portion 36 will be explained later. In this condition, the end cap 10 is secured to the end of the cylinder tube 2 by tightening self-tapping screws 14 into the ends of the grooves 4 (FIG. 2). The self-tapping screw 14 is a screw which cuts the thread on the wall of a screw hole by itself when it is screwed into the screw hole. In this embodiment, the self-tapping screws 14 are manufactured, for example, in accordance with JIS (Japanese Industrial Standard) No. B-1122. However, other self-tapping screws can be used as the screws 14. By using the self-tapping screws 14, since it is not required to cut the threads on the inner wall of the grooves 4 before attaching the end caps, the manufacturing process of the cylinder tube 2 is largely simplified. In this embodiment, since an inlet and outlet port 15 is provided on the side face of the respective end caps 10 and 11, three screws 14 are used for securing each of the end caps 10 and 11 as shown in FIG. 7.

The cylinder chamber 6 is divided into a fore cylinder chamber 6A and an aft cylinder chamber 6B by an internal moving body (a piston) 20 having piston ends 21 on both sides (FIG. 1). Piston ends 21 are provided with piston packing 21*a*. On the piston 20, a coupling member (a piston yoke) 22 for driving an external carriage through the slit 3 is formed integrally at the portion between the piston ends 21. At the end of the coupling member 22 outside of the cylinder tube 2, a piston mount 23 which acts as a base of the external carriage is integrally formed. The piston mount 23 has a left and right side faces 23*a*, 23*b* and a fore and aft side faces 23*c*, 23*d*. On the upper face of the piston mount 23, a recess 24 extending from the fore side face 23*c* to the aft side face 23*d* is formed. A cover member 25 made of, for example, synthetic resin is provided for covering the aperture of the recess 24. The recess 24, covered by the cover member 25 defines a passage through which an outer seal band 31 passes as shown in FIG. 4. The piston mount 23 and the cover member 25 constitute an external carriage 26. The piston 20, coupling member 22 and the piston mount 23 are formed integrally from, for example, aluminum alloy and constitute a moving body 27 as a whole. A scraper 28 is attached to the piston mount 23 around the lower periphery thereof in order to prevent the incursion of dust into the space between the cylinder tube 2 and the piston mount 23.

Figure 5:
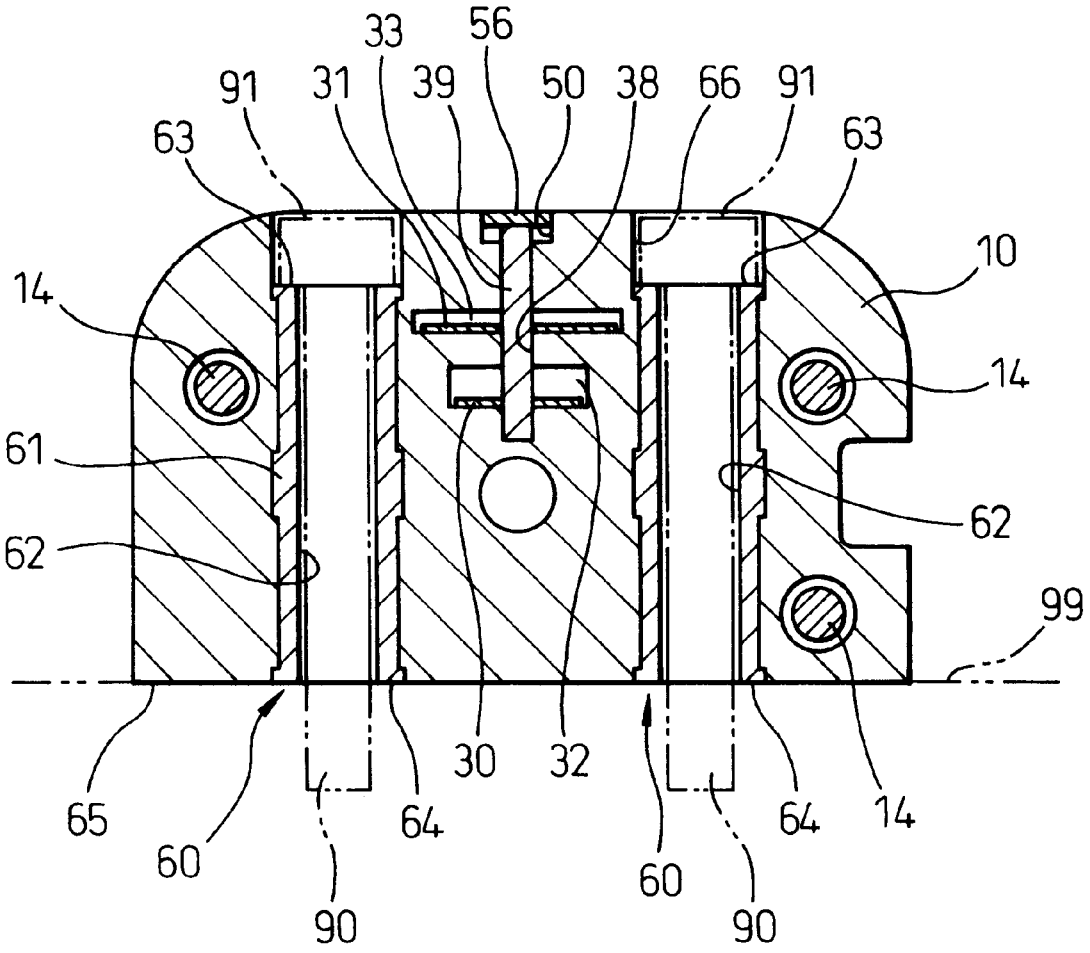
FIG. 5 is a sectional view taken along the line V—V in FIG. 2.
Figure 6:
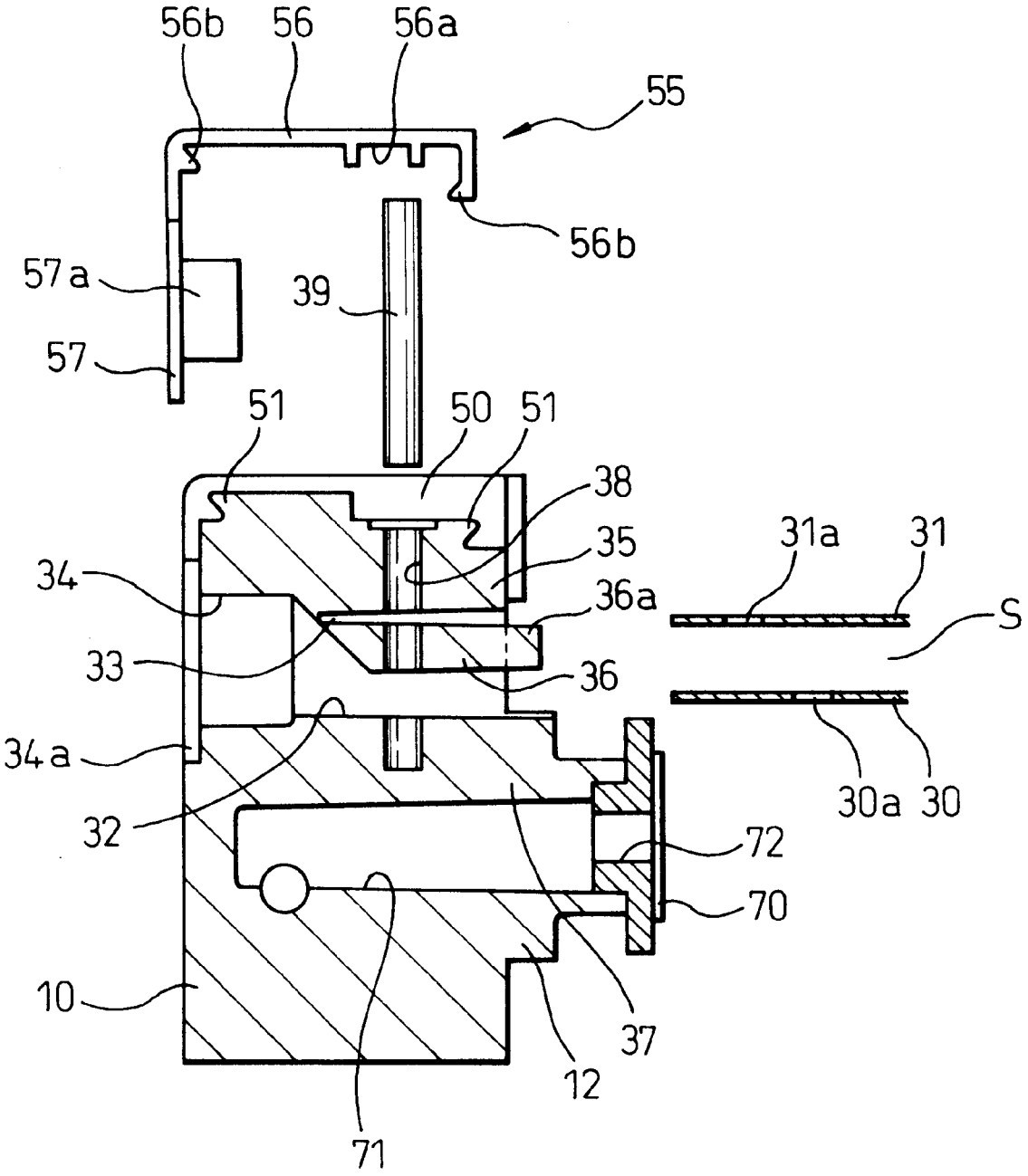
FIG. 6 is a drawing for explaining the process for attaching the seal bands to the end cap.

The end cap 10 and 11 in this embodiment is formed as a molded synthetic resin in order to reduce the weight and the manufacturing cost thereof. Recesses 32, 33 for inserting the ends of the outer seal band and the inner seal band, and an intermediate wall 36 between the recesses 32 and 33 are formed on the inside felce of the end cap 10 (and 11) (FIGS. 5 and 6). The widths of the recesses 32 and 33 may be the same as the widths of the seal bands 30 and 31 in order to position the seal bands. However in this embodiment, the width of the recesses are set larger than the width of the seal bands. Further, the height of the recess 32 for the inner seal band 30 is much greater than the thickness of the inner seal band 30 so that the recess 32 communicates with a space S (FIG. 1) formed between the inner seal band 30 and the outer seal band 31. A relieving passage 34 which connects the recess 32 to the outside is formed in the end cap 10 (FIG. 6). Reference numeral 38 in FIG. 6 is a pin hole which passes through the wall 35 above the recess 33, the intermediate wall 36 and the wall 37 below the recess 32. One end (the upper end) of the pin hole 32 forms an aperture open to the outside of the end cap 10.

Figure 9:
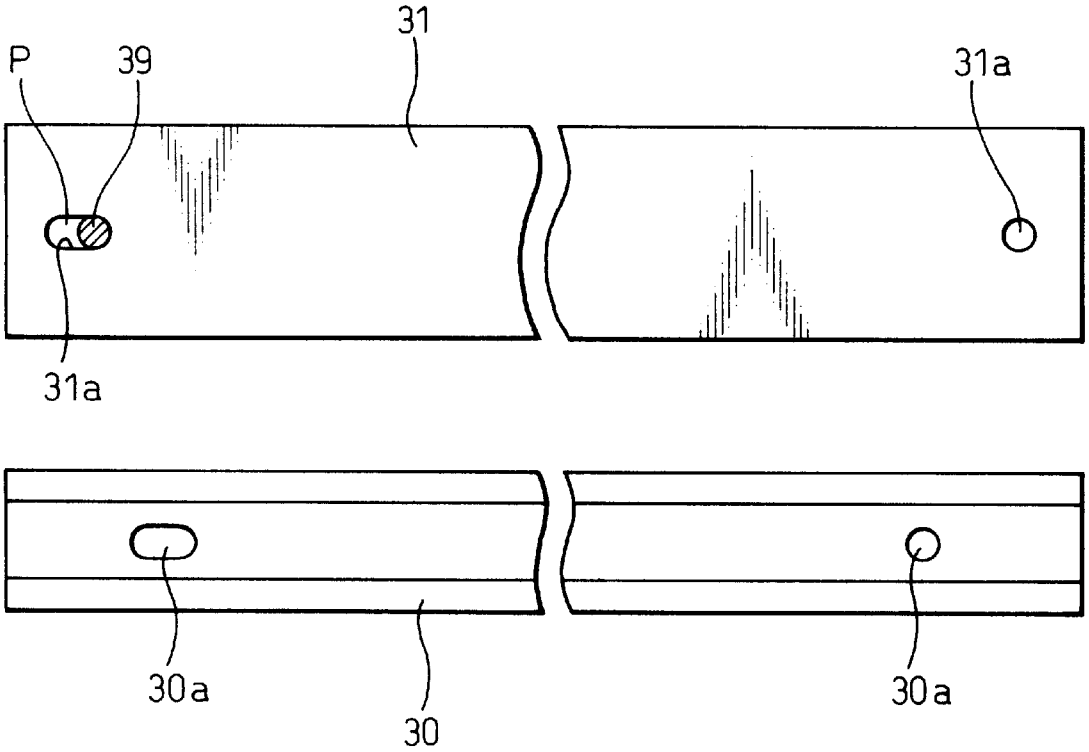
FIG. 9 shows the configurations of the inner and the outer seal bands.

The inner seal band 30 and the outer seal band 31 extend between end caps and pass the upper side and the lower side of the piston yoke 22, respectively. The inner seal band 30 covers the slit 3 from the inside of the cylinder tube 2, and the outer seal band 31 covers the slit from the outside of the cylinder tube 2. The inner seal band and the outer seal band in this embodiment are thin flexible bands made of, for example, a magnetic metal such as steel. The seal bands 30 and 31 have widths wider than the slit 3. As seen from FIG. 9, fitting holes 30*a* and 31*a* are provided on the both ends of the seal bands 30 and 31 at the positions corresponding to the pin hole 38 of the end caps 10 and 11 when the seal bands are set in place. One of the fitting holes 30*a* of the seal band 30 and one of the fitting holes 31*a* of the seal band 31 are formed as an oblong circular hole having a diameter along the longitudinal direction of the seal band slightly larger than the direction transverse to the seal band (FIG. 9). By disposing the oblong circular hole at one end of the seal band, a difference in the distance between the pin holes 38 in the end caps 10 and 11 due to the tolerances of the assembly of the end caps can be absorbed. As explained later, seal bands 30 and 31 are attracted to magnets 45 disposed on the cylinder tube 2 when the seal bands are installed. The oblong circular hole 31*a* of the outer seal band 31 is disposed at the end of the seal band 31 in such a manner that a clearance P is formed between the edge of the hole 31*a* and a fitting pin 39 at the outer side of the pin 39 (FIG. 9). The clearance P between the fitting pin 39 and the edge of the hole 31*a* permits the relative movement between the band 31 and the pin 39. Therefore, the outer seal band 31 is capable of deflecting outward against the attracting force of the magnets 45 when the pressure in the space S between the seal bands 30 and 31 increases to a certain level. This deflection permits the fluid in the space S to escape through the clearance between the cylinder tube 2 and the outer seal band 31 caused by the deflection. Therefore, the outer seal band 31 in this embodiment, which is provided with an oblong circular hole, is also capable of functioning as a relief valve.

The seal bands 30 and 31 are secured to the end caps 10 and 11 by inserting fitting pins 39 into the fitting holes from the outside of the end caps in such a manner that the pins 39 pass through the fitting holes 30*a* and 31*a*. Preferably, the condition of the fitting between the pin 39 and the hole 38 permits the insertion and pulling out of the pin 39 by finger pressure. The fitting pins 39 on the both end caps are disposed in parallel with each other. Further, the fitting pins 39 are firmly supported by the upper walls 35, the intermediate walls 36 and the lower walls 37 at the upper portion, the middle portion and the lower portion thereof, respectively. Since the pins 39 can be easily inserted by finger pressure, no tool is required for securing the seal bands 30 and 31. Therefore, the assembly process of the seal bends is largely simplified. The seal bands 30 and 31 are positioned to the end caps 10 and 11 by means of the fitting pins 39 and the fitting holes 30*a* and 31*a*. On the other hand, the end caps 10 and 11 are aligned to the slit 3 by inserting the protruded portions 36*a* into the slit. As a result, the seal bands 30 and 31 are aligned to the slit 3 by the fitting pins 39 and, thereby, the positioning error of the seal bands relative to the slit 3 in the direction of the width of the slit can be eliminated.

In this embodiment, magnets 45 are disposed on both sides of the slit 3 along the entire length thereof. Therefore, the seal bands 30 and 31 are attracted to the magnets 45 along the entire length except the portions thereof passing through the piston yoke 22. The inner seal band 30 adheres to and seals the slit 3 by the pressure of the fluid in the cylinder chamber 6 and the attracting force of the magnets 45. The outer seal band 31 also adheres to and seals the slit 3 by the attracting force of the magnets 45.

A shouldered groove 50 (FIG. 6) for fitting a cap cover 55 is formed on the upper face of the end cap 10. As seen from FIGS. 1 and 6, engage portions 51 are formed on the both ends of the groove 50. When inserted into the pin hole 38, the head of the fitting pin 39 protrudes into the groove 50. The cap cover 55 is formed from elastic synthetic resin and includes a cover portion 56 fitting to the groove 50 and a valve element 57 continuous to the cover portion 56. On the backside of the valve element 57, engaging portions 57*a* are formed. When inserted into the relieving passage 34, the engaging portions 57*a* resiliently engage both side walls of the passage 34 in order to hold the valve element 57 at the position closing the aperture 34*a* of the relieving passage 34.

The cover portion 56 is provided with hook-shaped engaging portions 56*b* for fitting to the engaging portions 51 of the groove 50. Further, a holding portion 56*a* is formed on the cover portion 56 in order to fit to the head of the fitting pin 39 and prevent the pin 39 from coming out. The engaging portions 51 of the groove 50 and the engaging portions 56*b* of the cover portion 56 form a resilient fastening means for attaching the cap cover 55 to the end cap 10. The cap cover 55 is fitted to the end cap 10 after inserting the pin 39 into the hole 38 by the snap fitting of the engaging portions 56*b* and 51. Further, the aperture 34*a* of the end member is closed, by the valve element 57, by resiliently deforming and inserting the engaging portions 57*a* into the relieving passage 34. When the cap cover 55 is fitted to the end cap 10, the fitting pin 39 is not visible from the outside and, thereby, the exterior view of the slide unit is not deteriorated by the heads of the pins 39. Further, since the cap cover does not require screws or bolts when it is fitted to the end cap, the process for fitting the cap cover is largely simplified. When the maintenance work on the seal bands 30 and 31 is done, it is only required to disengage the engaging portions 56*b* and 51 and pull out the fitting pins 39. Therefore, the maintenance work of the seal bands can be done without using any tools.

If a large amount of the fluid in the cylinder chamber 6 leaks into the space S between the inner seal band and the outer seal band, for example, due to a failure of the inner seal band, the pressure in the space S increases. When the pressure in the space 15 reaches to a predetermined pressure determined by the engagement between the engaging portions 57*a* of the valve element 57 and the walls of the passages 34, the valve elements 57 of the end caps 10 and 11 on both sides of the cylinder tube 2 disengage from the walls of the relieving passages 34 by the pressure in the passages 34 and uncover the openings 34*a* of the end caps 10 and 11. In this condition, since a large amount of fluid can flow out to the ambient through the relieving passages 34 on both sides of the cylinder tube 2, the pressure in the space S decreases to the value near the atmospheric pressure. Thus, a blow off of the outer seal band 31 does not occur. The valve element 57 may be made separately from the cover 56. However, in this embodiment, the number of the components is reduced by forming the valve element 57 and the cover St; as an integral component.

FIG. 5 shows a sectional view of the end cap(s) 10 (and 11) taken along the line V—V in FIG. 2. As shown in FIG. 5, the end cap 10 in this embodiment is provided with metal pipes (thread inserts) 60. The metal pipes 60 are embedded into the end cap 10 when the end cap 10 is molded from synthetic resin. At the middle of the metal pipes 60 are formed enlarged diameter portions 61. The outer surfaces of the enlarged diameter portions 61 are knurled in order to prevent the metal pipes from coming out from the end cap 10. In the metal pipe 60, bolt holes 62 are formed and, when the bolts are inserted into the bolt holes 62, the lower face of the bolt heads abut one end face 63 of the metal pipes 60. The other end face 64 of the metal pipe 60 is located on the same plane as the lower face (the face contacts the external structure) of the end cap 10, or, alternatively, the end face 64 may slightly protrude from the lower face of the end cap. Recesses 66 are formed in the end cap 10 for receiving the heads of the bolts.

When the slide unit is mounted to an external structure 99 such as a machine base plate, mounting bolts 90 are inserted into the bolt holes 62 of the end caps 10 and 11. When the mounting bolts are tightened, the tightening load of the bolts 90 are received by the metal pipes 60. Namely, the lower faces of the bolt heads contact the end faces 63 and the external structure contacts the end faces 64 and, thereby, no bolt tightening load is exerted on the portions of the end caps made of synthetic resin. Therefore, the slide unit can be firmly fixed to the external structure 99 without causing the deformation of the portions of the end caps made of synthetic resin and resulting loosening of the mounting bolts.

As seen from FIG. 6, an internal damper 10 is provided at the end of the portion 12 of the end caps 10 and 11. When the portion 12 is inserted into the bore 2*a* of the cylinder tube 2, the internal damper 70 abuts the piston end 21 when the piston 20 reaches its stroke end. The pressurized fluid is supplied to and discharged from the cylinder chamber 6 through an inlet and outlet ports 15 disposed on the side faces of the end caps 10 and 11 and passages 71 in the end caps and ports 72 at the center of the internal dampers 70. Further, each of the end caps 10 and 11 is provided with an external damper 80 which abuts the fore side wall 23*c* (or the aft side wall 23*d*) of the external carriage 26 when the carriage 26 reaches its stroke end. The internal damper 70 and the external damper 80 may abut the piston end 21 and the wall 23*c* (23*d*) simultaneously, or alternatively, the dampers 70 and 80 may abut their counterparts one after another successively.

The dampers 70 and 80 are made of resilient material such as rubber. As seen from FIGS. 2 and 7, the external damper 80 is provided with lower end portions 81 extending along the grooves 4 of the cylinder tube 2. Further, insert member 82 is provided on each of the ends of the extended lower end portions 81 as shown in FIG. 2. The length of the lower end portions 81 are determined in such a manner that the insert members 82 are located inside the ends of the self-tapping screws 114 when the dampers 80 contacts the end caps 10 and 11. The dampers 80 are attached to the cylinder tube 2 by inserting the insert members 82 into the grooves 4 at the position inside the tips of the self-tapping screws 14. Therefore, two self-tapping screws 14 on both sides of the cylinder tube 2 are covered by the lower end portions 81 of the dampers 80.

Figure 10:
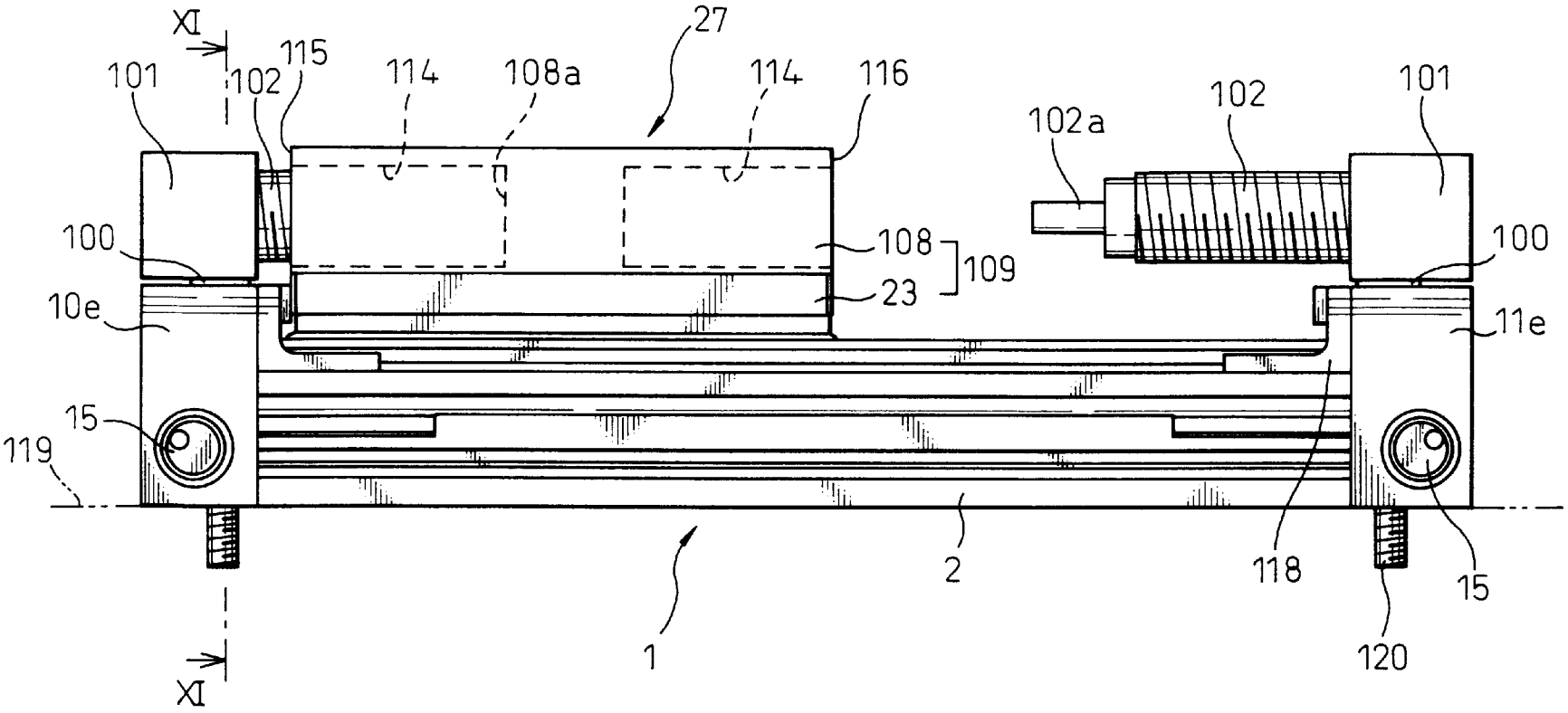
FIG. 10 is a side view of the slide unit according to another embodiment of the present invention.
Figure 11:
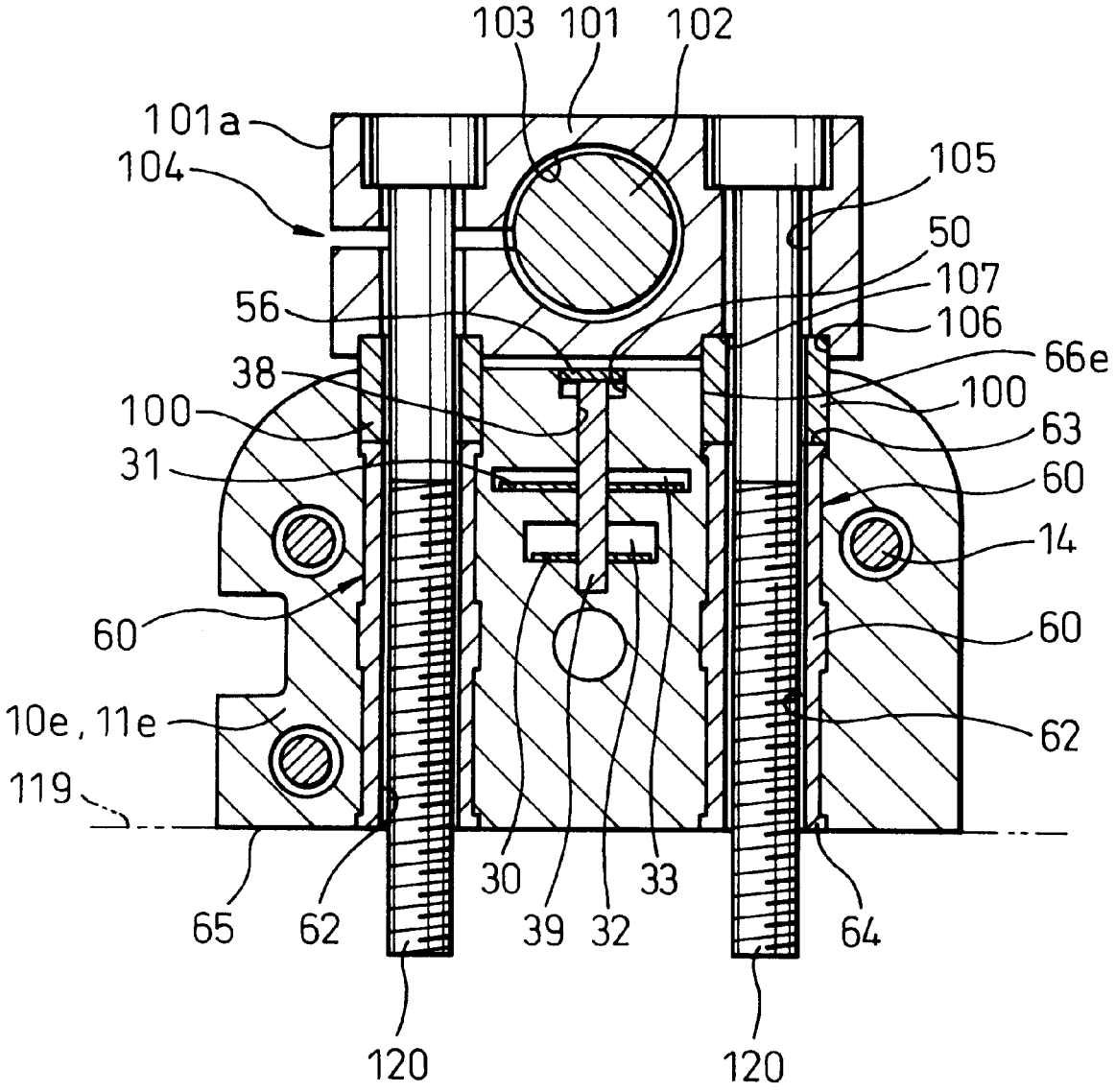
FIG. 11 is a sectional view taken along the line XI—XI in FIG. 10.

FIGS. 10 and 11 show another embodiment of the slide unit according to the present invention. In FIGS. 10 and 11, reference numeral 102 designate shock absorbers used as stoppers in this embodiment. The shock absorbers 102 are fixed on the end caps 10e and lle by means of positioning members 100 and stopper holders 101. On the stopper holders 101, threaded holes 103 are formed to receive the shock absorbers 102. On the peripheries of the shock absorbers 102, male threads are formed, and the shock absorbers 102 are secured to the stopper holders 101 by screwing the shock absorbers 102 into the threaded holes 103 on the stopper holders 101.

The stopper holders 101 are provided with notches 104 at the positions between the threaded holes 103 and one side surfaces 101*a*. The stopper holders 101 are also provided with vertical through holes 105 at the positions corresponding to the positions of the mounting holes 62 of the end caps. One of the through holes 105 of each end cap crosses the notches 104. The upper end of each mounting hole 62 of the end caps is counter-bored and forms a bore 66*e*. The lower end of each through hole is enlarged in diameter so that a positioning hole 106 having a diameter same as the bore 66 is formed. When fixing the stopper holders 101 on the end caps 10*e* and 11*e*, each positioning hole 106 is aligned to the bore 66*e* by inserting a cylindrical inserting member 100 into both the positioning hole 106 and the bore 66*e*. By using the positioning member 100, each stopper holder 101 is positioned precisely relative to each end cap. Each positioning member 100 is provided with a center hole 107 and, when the positioning member 100 is set, each through hole 105 and the mounting hole 62 form a continuous through hole extending from the upper face of the stopper holder 101 to the bottom face of the end cap.

In this embodiment, a plate 108 is attached to the piston mount 23, and the external carriage 109 is formed by the plate 108 and the piston mount 23. The plate 108 is provided with holes 114 extending in longitudinal direction from end faces 115 and 116. Each hole 114 is capable of receiving the shock absorber 102. The wall 108*a* which separates the holes 114 abuts the shock absorbers 102 when the external carriage 109 reaches its stroke end.

Reference numeral 118 in FIG. 2 designates an external damper in this embodiment. The external dampers 118 are attached to the faces of the end caps 10*e* and 11*e* opposing the external carriage 109 and abut the carriage 109 when it reaches its stroke end.

When the slide unit 1 is fixed to an external structure 119 such as machine base, the stopper holders 101 are fitted to corresponding end caps by the positioning members 100. In this condition, mounting bolts 120 are inserted into the through holes 105 of the stopper holders 101 and the mounting holes 62 of the end caps through the center holes of the positioning members 100, and are tightened to the external structure 119. The shock absorbers 102 are fixed to the stopper holders 101 in such a manner that the outer ends of the shock absorbers 102 do not protrude outside the outer end faces of the end caps 10*e* and 11*e*. In this configuration, the shock absorbers 102 are inserted into the holes 114 in the plate 108 when the external carriage 109 reaches its stroke end. Therefore, a long stroke of the external carriage can be obtained even if the length of the cylinder tube 2 is short. This makes the whole length of the slide unit short even though shock absorbers are used.

As explained above, the seal bands are secured to the end members by only fitting pins according to the present invention. Therefore, the assembly process of the seal bands is largely simplified. Further, since synthetic resin having a low strength can be used as the material of the end caps, the manufacturing cost and the weight of the slide unit are reduced.

Further, since the cap cover attached to the end cap by snap fitting is used for covering the fitting pins, the exterior view is not deteriorated by the heads of the fitting pins. In addition to that, since the cap cover acts as the stopper for preventing the fitting pins from coming out, the seal bands are reliably secured to the end caps in spite of a simple fitting arrangement.

When the slide unit is fixed to the external structure by fitting the end caps to the external structure by the mounting bolts, the metal pipes embedded in the end caps receive substantially all the tightening load of the mounting bolts. Therefore, even though the end caps are made of synthetic resin, the deformation of the end caps and resulting loosening of the mounting bolts do not occur.

Further, since the end caps are attached to the cylinder tube by means of self-tapping screws, the necessity for cutting threads in the internal surfaces of the holes drilled on the end faces of the cylinder tube is eliminated. This makes the manufacturing process of the slide unit largely simplified.

Further, since the stop members in the present invention are secured to the end caps, the stop members can be attached to the cylinder tube without damaging the cylinder tube. The strength of the cylinder tube is also increased by this fitting arrangement of the stop members.

We claim:

1. A slide unit comprising:

a cylinder barrel provided with a slit which penetrates the wall of the cylinder barrel and extends parallel to the axis of the cylinder barrel;

end members fitted to both ends of the cylinder barrel and closing both ends of a bore of the cylinder barrel;

an internal moving body, having two ends, disposed in the bore of the cylinder barrel and movable therein in the direction parallel to the axis of the cylinder barrel;

an external carriage disposed outside of the cylinder barrel and coupled to the internal moving body by a coupling member through the slit in the cylinder barrel so that said carriage moves with the internal moving body along said slit; and a seal band provided with a fitting hole at each end portion thereof, said seal band being disposed along the slit in the cylinder barrel so that the seal band covers the slit in the cylinder barrel;

wherein each of the end members is provided with a recess formed on an end face opposing the cylinder barrel for receiving the end portion of the seal band and a pin hole extending from the surface of the end member and traversing said recess, and wherein the seal band is attached firmly to the end members by inserting a fitting pin into the pin hole of each end member in such a manner that the fitting pin passes through the fitting hole at the end portion of the seal band.

2. A slide unit as set forth in claim 1, wherein an outer seal band covering the slit from the outside of the cylinder barrel and an inner seal band covering the slit from the inside of the cylinder barrel are provided, and wherein separate recesses for receiving the ends of the outer seal band and the inner seal band are formed in the end members, said recesses are arranged in such a manner that one fitting pin is capable of passing through the fitting hole of one end of both the outer seal band and the inner seal band through the fitting holes thereof.

3. A slide unit as set forth in claim 1, further comprising an end cover fitted to each end member by resilient fastening means, said end cover covers the end of the fitting pin when the end cover is fitted to the end member and prevents the fitting pin from coming out.

4. A slide unit as set forth in claim 2, further comprising an end cover fitted to each end member by resilient fastening means, said end cover covering the end of the fitting pin when the end cover is fitted to the end member and preventing the fitting pin from coming out.

5. A slide unit as set forth in claim 3, wherein the resilient fastening means comprises a hook portion formed on the end cover and an engaging portion formed on the end member and, said hook portion is capable of engaging said engaging portion by deforming resiliently.

6. A slide unit as set forth in claim 4, wherein the resilient fastening means comprises a hook portion formed on the end cover and an engaging portion formed on the end member and, said hook portion being capable of engaging said engaging portion by deforming resiliently.

7. A slide unit as set forth in claim 4 or claim 6, wherein said internal moving body is moved by pressurized fluid introduced into the bore of the cylinder barrel, and wherein a relieving passage communicating the space between the inner and the outer seal band to the outside of the cylinder barrel is formed in the end member, and wherein said end cover includes a pressure relieving means for closing the relieving passage when the pressure in the space is lower than a predetermined value and for opening the relieving passage when the pressure in the space becomes higher than the predetermined value.

8. A slide unit as set forth in claim 1, wherein the end member is made of synthetic resin with a metal pipe embedded therein, said metal pipe acts as a sleeve through which a mounting bolt for securing the slide unit to an external structure passes and is arranged in such a manner that one end of the metal pipe abuts the head of the mounting bolt and the other end of the metal pipe abuts the surface of the external structure when the slide unit is secured to the external structure by the mounting bolt.

9. A slide unit as set forth in claim 1, wherein said cylinder barrel is formed by an extrusion process or a drawing process, and wherein a through hole extending in parallel with the axis of the cylinder barrel along the entire length thereof is formed, and wherein the end members are fitted to both ends of the cylinder barrel by self-tapping screws screwed into said through hole.

10. A slide unit as set forth in claim 9, wherein a slit opening to the outside of the cylinder barrel and extending parallel to the axis of the through hole along the entire length thereof is formed on the wall of the fitting bolt hole.

11. A slide unit as set forth in claim 1 further comprising stopper members at both ends of the cylinder barrel for defining the ends of the stroke of the external carrier, wherein a mounting bolt hole for receiving a mounting bolt for securing the slide unit to an external structure is formed in each end member, and each of said stopper members is secured to the end member by means of the same mounting bolt securing the slide unit to the external structure.

12. A slide unit as set forth in claim 11, wherein said stopper member comprises a stopper for abutting the external carriage at the end of the stroke thereof, a stopper holder holding the stopper and a positioning member disposed between the stopper holder and the end member for adjusting the position of the stopper holder relative to the end member, and wherein the stopper holder is provided with a mounting bolt hole through which the mounting bolt for securing the end member to the external structure passes, thereby the stopper holder is secured to the end member by the same mounting bolt securing the slide unit to the external structure.

13. A slide unit as set forth in claim 12, wherein the stopper and the stopper holder are located between the planes defined by the end faces of both end members.

14. A slide unit as set forth in claim 12 or claim 13, further comprising means for adjusting the position of the stopper in the direction along the axis of the cylinder barrel.

* * * * *